US009297052B2

(12) United States Patent
Kimura et al.

(10) Patent No.: US 9,297,052 B2
(45) **Date of Patent: *Mar. 29, 2016**

(54) HIGH STRENGTH COLD ROLLED STEEL SHEET WITH EXCELLENT DEEP DRAWABILITY AND MATERIAL UNIFORMITY IN COIL AND METHOD FOR MANUFACTURING THE SAME

(75) Inventors: Hideyuki Kimura, Tokyo (JP); Yasunobu Nagataki, Tokyo (JP); Kaneharu Okuda, Tokyo (JP); Kenji Kawamura, Tokyo (JP)

(73) Assignee: JFE Steel Corporation (JP)

( * ) Notice: Subject to any disclaimer, the term of this patent is extended or adjusted under 35 U.S.C. 154(b) by 51 days.

This patent is subject to a terminal disclaimer.

(21) Appl. No.: 14/351,264

(22) PCT Filed: Aug. 23, 2012

(86) PCT No.: PCT/JP2012/005281

§ 371 (c)(1),
(2), (4) Date: Apr. 11, 2014

(87) PCT Pub. No.: WO2013/054464

PCT Pub. Date: Apr. 18, 2013

(65) Prior Publication Data

US 2014/0290810 A1 Oct. 2, 2014

(30) Foreign Application Priority Data

Oct. 13, 2011 (JP) ..... 2011-225429
Aug. 16, 2012 (JP) ..... 2012-180436

(51) Int. Cl.

| | |
|---|---|
| ***C21D 8/02*** | (2006.01) |
| ***C21D 9/48*** | (2006.01) |
| ***C22C 38/00*** | (2006.01) |
| ***B21B 1/26*** | (2006.01) |
| ***B21B 3/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/60*** | (2006.01) |
| ***C21D 8/04*** | (2006.01) |

(52) U.S. Cl.

CPC ..... *C21D 8/0236* (2013.01); *B21B 1/26* (2013.01); *B21B 3/00* (2013.01); *C21D 8/0263* (2013.01); *C21D 8/0405* (2013.01); *C21D 8/0436* (2013.01); *C21D 8/0463* (2013.01); *C21D 9/48* (2013.01); *C22C 38/00* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/60* (2013.01); *C21D 2211/005* (2013.01); *C21D 2211/008* (2013.01)

(58) Field of Classification Search

CPC ..... C21D 9/48; C21D 2211/005; C21D 2211/008; C21D 8/0236; C21D 8/0263; C21D 8/0405; C21D 8/0463; B21B 1/26; B21B 3/00; C22C 38/00; C22C 38/001; C22C 38/02; C22C 38/04; C22C 38/06; C22C 38/08; C22C 38/12; C22C 38/14; C22C 38/16; C22C 38/22; C22C 38/24; C22C 38/26; C22C 38/28

USPC ..... 148/603, 651, 332, 333, 336, 337

See application file for complete search history.

(56) References Cited

U.S. PATENT DOCUMENTS 4,445,946 A * 5/1984 Takahashi ..... C22C 38/14 148/320
5,853,903 A * 12/1998 Hosoya ..... C22C 38/12 148/320

(Continued)

FOREIGN PATENT DOCUMENTS

JP 55-10650 3/1980
JP 57-57945 12/1982

(Continued)

OTHER PUBLICATIONS

English translation of JP 2011/219855; Nov. 2011; 39 pages.*

(Continued)

*Primary Examiner* — Helene Klemanski
(74) *Attorney, Agent, or Firm* — DLA Piper LLP (US)

(57) ABSTRACT

A high strength cold rolled steel sheet includes a chemical composition containing, by mass %, C: 0.010% or more and 0.060% or less, Si: more than 0.5% and 1.5% or less, Mn: 1.0% or more and 3.0% or less, P: 0.005% or more and 0.100% or less, S: 0.010% or less, sol.Al: 0.005% or more and 0.500% or less, N: 0.0100% or less, Nb: 0.010% or more and 0.100% or less, Ti: 0.015% or more and 0.150% or less and the balance comprising Fe and inevitable impurities. The microstructure includes, in area fraction, 70% or more of a ferrite phase and 3% or more of a martensite phase. The tensile strength is 440 MPa or more and an average r value is 1.20 or more.

12 Claims, No Drawings

(56) References Cited

U.S. PATENT DOCUMENTS

| | | | | |
|---|---|---|---|---|
| 6,494,969 | B1 * | 12/2002 | Fujita | C22C 38/12 148/603 |
| 7,534,312 | B2 * | 5/2009 | Yoshinaga | C22C 38/04 148/332 |
| 7,686,896 | B2 * | 3/2010 | Yoshida | C22C 38/12 148/333 |
| 2003/0129444 | A1 * | 7/2003 | Matsuoka | C22C 38/001 148/651 |
| 2013/0213529 | A1 * | 8/2013 | Kimura | C22C 38/04 148/337 |
| 2013/0292010 | A1 * | 11/2013 | Kimura | C21D 8/0405 148/337 |
| 2014/0363695 | A1 * | 12/2014 | Kimura | C21D 9/48 148/533 |

FOREIGN PATENT DOCUMENTS

| | | |
|---|---|---|
| JP | 61-32375 | 7/1986 |
| JP | 2000-303141 | 10/2000 |
| JP | 2002-226941 | 8/2002 |
| JP | 2003-064444 | 3/2003 |
| JP | 2005-120467 | 5/2005 |
| JP | 2005-256020 | 9/2005 |
| JP | 2005-264212 | 9/2005 |
| JP | 2006-193819 | 7/2006 |
| JP | 2008-174825 | 7/2008 |
| JP | 2010-018852 | 1/2010 |
| JP | 2011/219855 | * 11/2011 |
| JP | 2012-112039 | 6/2012 |
| JP | 2013-64193 | 4/2013 |
| WO | 2010/074458 | 7/2010 |
| WO | WO 2012/043420 A1 * | 4/2012 |
| WO | WO 2012/060294 A1 * | 5/2012 |

OTHER PUBLICATIONS

Supplementary European Search Report dated Jan. 20, 2016 of corresponding European Application No. 12839838.5.

* cited by examiner

HIGH STRENGTH COLD ROLLED STEEL SHEET WITH EXCELLENT DEEP DRAWABILITY AND MATERIAL UNIFORMITY IN COIL AND METHOD FOR MANUFACTURING THE SAME

TECHNICAL FIELD

This disclosure relates to a high strength cold rolled steel sheet with excellent deep drawability and material uniformity in a coil which can be suitably used for, for example, the inner and outer panels of automobile bodies, and a method of manufacturing the steel sheet.

BACKGROUND ART

In recent years, improvement of the fuel efficiency of automobiles is required to control $CO_2$ emission from the viewpoint of global environment conservation. In addition to this, an improvement in safety, such as the crashworthiness of automobile bodies is also required to guarantee occupant safety when an automobile crush occurs. Therefore, the progress is made in the weight reduction and strengthening of automobile bodies.

It is said that, to realize the weight reduction and strengthening of automobile bodies at the same time, it is effective to reduce the weight of automobile bodies by the high strengthening of the steel sheets and by decreasing the thickness of the steel sheets as long as there is no problem regarding stiffness, and high strength steel sheets are actively used for the parts of automobiles nowadays.

On the other hand, since many automobile parts made from a steel sheet are formed by press forming, a steel sheet used for automobiles is required to have good press formability. However, since a high strength steel sheet is much poorer in terms of formability, in particular deep drawability, than an ordinary mild steel sheet, there is an increased desire for a steel sheet having a tensile strength TS of 440 MPa or more and good deep drawability to reduce the weight of automobile bodies. Specifically, in terms of Lankford value (hereinafter, referred to as r value) which is the evaluation indicator of deep drawability, a steel sheet having an average r value of 1.20 or more is required.

In addition, since a high strength steel sheet contains various alloy elements in large amounts to realize high strengthening, the kinds and amounts of precipitates present in the steel, widely vary due to change in manufacturing conditions, which results in a tendency for change in mechanical properties in a coil to increase in particular in the longitudinal direction of the coil. In the case where change in mechanical properties is large, it is difficult to stably perform press forming in a continuous pressing line for automobile bodies, which results in a significant decrease in operability. Therefore, the uniformity of the mechanical property in a coil is strongly required.

To solve the problems described above, as a means of increasing strength while maintaining a high r value, for example, Japanese Examined Patent Application Publication No. 57-57945 discloses a method using an ultralow-carbon steel sheet in which chemical elements such as Si, Mn and P which are effective for solid solution strengthening are added to a base steel which is made interstitial atom free steel by adding Ti and Nb which are effective for fixing carbon and nitrogen which form solid solutions in steel.

However, to manufacture a high strength steel sheet having a tensile strength of 440 MPa or more by using the method described above in which chemical elements which are effective for solid solution strengthening are added to an ultralow-carbon steel, there is an increase in the amount of added alloy elements. For example, in the case where the Si content is large, Si becomes concentrated on the surface of the steel sheet when continuous annealing is performed and combines with a small amount of water vapor in the atmosphere, Si oxides are formed on the steel sheet surface, which results in a significant decrease in phosphatability. In addition, in the case where the P content is large, P is segregated at grain boundaries, which results in a significant decrease in resistance to secondary working brittleness. In the case where the Mn content is large, there is a decrease in r value. Moreover, r value decreases remarkably with high strengthening.

In addition, there is a method of obtaining a high strength steel sheet other than a solid solution strengthening method described above. A complex phase steel sheet consisting of a soft ferrite phase and a hard martensite phase generally has good ductility, good strength-ductility balance, and low yield strength. Therefore, the steel sheet has comparatively good press formability. However, the steel sheet has a low r value and poor deep drawability. This is said to be because solid solution C (solute C), which is necessary to form a martensite phase, suppresses the formation of a {111} recrystallization texture, which is effective in increasing an r value.

As a technique to improve the r value of a complex phase steel sheet described above, for example, Japanese Examined Patent Application Publication No. 55-10650 discloses a method in which box annealing is performed at a temperature between the recrystallization temperature and the $Ac_3$ transformation point after cold rolling has been performed, the annealed steel sheet is heated up to a temperature of 700° C. to 800° C., and the heated steel sheet is quenched and tempered. In addition, Japanese Unexamined Patent Application Publication No. 2003-64444 discloses a high strength steel sheet having a predefined C content, a microstructure including one or more of bainite, martensite and austenite phases in an amount of 3% or more in total, and an average r value of 1.3 or more. However, both the techniques disclosed in Japanese Examined Patent Application Publication No. 55-10650 and Japanese Unexamined Patent Application Publication No. 2003-64444 require annealing to increase the r value by growing a texture as a result of forming clusters and precipitates of Al and N and require heat treatment to form a desired microstructure. Further, in the techniques, box annealing is required for a long duration of one hour or more. Therefore, since box annealing is necessary, the treatment time is longer than that of continuous annealing and there is an increase in the number of processes, which results in a significant decrease in efficiency and productivity, that is, a decrease in economic efficiency from the viewpoint of manufacturing cost, and which results in many problems in the manufacturing process such as the frequent occurrence of adhesion between steel sheets, the occurrence of temper color, and a decrease in the service life of the inner cover of the furnace body.

Moreover, Japanese Unexamined Patent Application Publication No. 2002-226941 discloses a technique in which the r value of a complex phase steel sheet is improved by appropriately controlling C and V contents. In that technique, the amount of solid solution C is decreased as much as possible by precipitating C in the steel in the form of carbides containing V before recrystallization annealing is performed to increase an r value, and then the carbides containing V are dissolved by heating the steel sheet under the conditions for forming an $\alpha$-$\gamma$ dual phase to concentrate C in the $\gamma$ phase, which results in the formation of a martensite phase in a cooling process afterwards.

However, in the method in which carbides containing V is dissolved when annealing is performed under the conditions for a dual phase, since there is a concern that mechanical properties may vary due to variation in dissolving speed, it is necessary to control an annealing temperature and an annealing time with a high degree of accuracy, which results in a problem in manufacturing stability in practice.

In addition, Japanese Unexamined Patent Application Publication No. 2005-120467 discloses a technique in which an increase in r value and formation of a complex phase are realized at the same time by controlling a chemical composition to contain, by mass %, the C: 0.010% to 0.050% and the Nb content and the C content to satisfy the relationship $0.2 \leq (Nb/93)/(C/12) \leq 0.7$. An increase in r value is intended in this technique by retaining solid solution C, which is necessary to form a martensite phase after annealing, at the stage of hot rolled steel sheet and by utilizing an effect of grain refinement of the microstructure of a hot rolled steel sheet by adding Nb and an effect of decreasing the amount of solid solution C due to the precipitation of NbC.

However, in the technique disclosed in Japanese Unexamined Patent Application Publication No. 2005-120467, since an increase in r value is intended by utilizing an effect of grain refinement of the microstructure of a hot rolled steel sheet by adding Nb and an effect of decreasing the amount of solid solution C due to the precipitation of NbC, there are problems in that Nb is very expensive and in that Nb significantly delays the recrystallization of an austenite phase, which results in an increase in the rolling load at hot rolling. In addition, Nb which is precipitated in a hot rolled steel sheet causes an increase in deformation resistance when cold rolling is performed, which results in an increased risk that troubles may occur due to an increase in load on rolls, and which results in such problems that there are a decrease in productivity and a restriction on the available width of products. Moreover, in the case of the carbon content described above (0.010% to 0.050%), since it is difficult to control the precipitation state of NbC in a hot rolled steel coil, in particular at the front and tail edges of the coil, a cold rolled steel sheet which is made of the material having this kind of chemical composition tends to have non-uniform distribution of mechanical properties in the coil in the longitudinal direction, which results in a problem of uniformity of mechanical property in a coil.

As described above, many techniques to improvement of uniformity of mechanical property in a coil of a cold rolled steel sheet have been proposed. For example, Japanese Examined Patent Application Publication No. 61-032375 discloses a technique in which the uniformity of mechanical property in a coil is improved by adding the combination of Ti and Nb to steel having a decreased C content of 0.0070% or less and by hot rolling the steel under the condition that the coiling temperature is 620° C. or higher. In this technique, N which causes variation in mechanical properties is precipitated in the form of TiN instead of AlN before finish rolling and C is precipitated as a compound carbide in the form of (Ti, Nb)C. However, in practical operation, there is a case where a coiling temperature is 600° C. or lower or where the temperature of some part of a coil is 600° C. or lower, and in such cases there is a problem of an increase in variation in mechanical properties due to the variation of precipitation behavior in a coil. In particular, in the case where the atom ratio of Ti and Nb with respect to C is small, C is not sufficiently fixed by precipitation, and a deterioration of mechanical properties increases at the front and tail edges of a coil which are comparatively prone to be cooled.

In addition, Japanese Unexamined Patent Application Publication No. 2000-303141 discloses a technique in which dependence of mechanical properties such as strength and elongation on a coiling temperature is decreased by controlling a chemical composition such that the C content is more than 0.0050% and 0.010% or less and $(Nb\%\times12)/(C\%\times93)$ is 1.6 to 2.4. However, that technique is intended for ferrite single phase steel which is made using IF steel (Interstitial Free steel) as base steel, which is ultralow-carbon steel, and there is no mention of a high strength steel sheet having a tensile strength of 440 MPa or more.

As described above, in the case of a method of high strengthening of a steel sheet by solid solution strengthening which has been investigated in order to increase the strength of a mild steel sheet having good deep drawability, it is necessary to add large amounts of alloy elements, which causes problems, for example, regarding cost and phosphatability and regarding increasing r value.

In addition, in the case of the methods utilizing transformation strengthening, it is necessary to perform annealing twice and to use a high speed cooling apparatus, and therefore there are problems in manufacturing processes. Although a method utilizing V and C is also disclosed, there is a concern that mechanical properties may vary due to variation in the dissolving speeds of V and C, and it is necessary to control an annealing temperature and an annealing time with a high degree of accuracy, which results in a problem in manufacturing stability in practice.

Moreover, although a technique in which an increase in the r value of a dual steel sheet is intended by utilizing an effect of grain refinement of the microstructure of a hot rolled steel sheet by adding Nb and an effect of decreasing the amount of solid solution C due to the precipitation of NbC is disclosed, there are problems in that Nb is very expensive and Nb significantly delays the recrystallization of an austenite phase, which results in an increase in the rolling load at hot rolling. Moreover, NbC which is precipitated in a hot rolled steel sheet causes an increase in deformation resistance when cold rolling is performed, which results in difficulty in stable manufacturing in practice. Moreover, regarding uniformity of mechanical property in a coil, it is difficult to control the precipitation state of NbC in a hot rolled steel coil, in particular at the front and tail edges of the coil, which results in non-uniform distribution of mechanical properties in the longitudinal direction in a coil.

It could therefore be helpful to provide a high strength cold rolled steel sheet with excellent deep drawability and uniformity of mechanical property in a coil which is suitably used for the inner and outer panels of automobile bodies and a method for manufacturing the steel sheet.

SUMMARY

We conducted investigations on various factors having influences on the strengthening and deep drawability of a steel sheet, productivity which is important for the industrial mass production of a steel sheet, and uniformity of mechanical property in a coil. We found that it is possible to manufacture a high strength cold rolled steel sheet with excellent deep drawability having a microstructure including, in area fraction, 70% or more of a ferrite phase and 3% or more of a martensite phase and having a tensile strength (hereinafter, also referred to as TS) of 440 MPa or more and an average r value of 1.20 or more by controlling a chemical composition to contain, by mass %, C: 0.010% or more and 0.060% or less, N: 0.0100% or less, Nb: 0.010% or more and 0.100% or less, Ti: 0.015% or more and 0.150% or less, and S: 0.010% or less, in which the relationship between Nb and C "(Nb/93)/(C/12): less than 0.20" is satisfied and in which the amount of C*

(solid solution C), which is not fixed by Nb or Ti, is controlled to be within a specified range and by performing heating for annealing at a low average heating rate of less than 3° C./s in a temperature range from 700° C. to 800° C.

In addition, regarding uniformity of mechanical property in a coil, we found that it is possible to realize the uniform formation of precipitates in a hot rolled steel coil by controlling a chemical composition to satisfy the relationship (Nb/93+Ti*/48)/(C/12) 0.150, by controlling the rolling reduction ratios of the last 2 passes of finish rolling in hot rolling and controlling cooling conditions after the finish rolling and a coiling temperature, which results in excellent uniformity of mechanical property in a coil to be obtained after annealing.

We thus provide:

[1] A high strength cold rolled steel sheet with excellent deep drawability and uniformity of mechanical property in a coil, the steel sheet having a chemical composition containing, by mass %, C: 0.010% or more and 0.060% or less, Si: more than 0.5% and 1.5% or less, Mn: 1.0% or more and 3.0% or less, P: 0.005% or more and 0.100% or less, S: 0.010% or less, sol.Al: 0.005% or more and 0.500% or less, N: 0.0100% or less, Nb: 0.010% or more and 0.100% or less, Ti: 0.015% or more and 0.150% or less, and the balance comprising Fe and inevitable impurities, in which relational expressions (1), (2), and (3) below are satisfied, a microstructure includes in area fraction, 70% or more of a ferrite phase and 3% or more of a martensite phase, and a tensile strength is 440 MPa or more and an average r value is 1.20 or more:

$$(Nb/93)/(C/12)<0.20 \quad (1),$$

$$0.005\leq C^*\leq 0.025 \quad (2),$$

$$(Nb/93+Ti^*/48)/(C/12)\geq 0.150 \quad (3),$$

where, atomic symbol M represents the content (mass %) of the chemical element represented by the symbol M in relational expressions (1), (2), and (3), where $C^*=C-(12/93)Nb-(12/48)Ti^*$ and where $Ti^*=Ti-(48/14)N-(48/32)S$, in which $Ti-(48/14)N-(48/32)S=0$ in the case where $Ti-(48/14)N-(48/32)S\leq 0$.

[2] The high strength cold rolled steel sheet with excellent deep drawability and uniformity of mechanical property in a coil according to item [1], in which the steel sheet has the chemical composition further containing, by mass %, at least one chemical element selected from among Mo, Cr, and V in a total amount of 0.50% or less.

[3] The high strength cold rolled steel sheet with excellent deep drawability and uniformity of mechanical property in a coil according to item [1] or [2], in which the steel sheet has the chemical composition further containing, by mass %, one or two selected from Cu: 0.30% or less and Ni: 0.30% or less.

[4] The high strength cold rolled steel sheet with excellent deep drawability and uniformity of mechanical property in a coil according to any one of items [1] to [3], in which the steel sheet has the chemical composition further containing, by mass %, one or two selected from Sn: 0.20% or less and Sb: 0.20% or less.

[5] The high strength cold rolled steel sheet with excellent deep drawability and uniformity of mechanical property in a coil according to any one of items [1] to [4], in which the steel sheet has the chemical composition further containing, by mass %, Ta: 0.01% or more and 0.10% or less, and in which relational expression (4) below instead of relational expression (2) above is satisfied:

$$0.005\leq C^*\leq 0.025 \quad (4),$$

where $C^*=C-(12/93)Nb-(12/181)Ta-(12/48)Ti^*$ and where $Ti^*=Ti-(48/14)N-(48/32)S$, in which $Ti-(48/14)N-(48/32)S=0$ in the case where $Ti-(48/14)N-(48/32)S\leq 0$.

[6] A method for manufacturing a high strength cold rolled steel sheet with excellent deep drawability and uniformity of mechanical property in a coil, the method including hot rolling a steel material having a chemical composition according to any one of items [1] to [5], cold rolling, and annealing, in which the rolling reduction ratio of the last pass of finish rolling in the hot rolling is 10% or more and the rolling reduction ratio of the second last pass is 15% or more, and the cold rolled steel sheet is heated up to a temperature of 800° C. to 900° C. at an average heating rate of less than 3° C./sec. in a temperature range from 700° C. to 800° C. and then cooled down to a cooling stop temperature of 500° C. or lower at an average cooling rate of 5° C./sec. or more in the annealing.

[7] The method for manufacturing a high strength cold rolled steel sheet with excellent deep drawability and uniformity of mechanical property in a coil according to item [6], the method further including cooling that starts within three seconds after the finish rolling has been finished in the hot rolling, cooling the hot rolled steel sheet down to a temperature of 720° C. or lower at an average cooling rate of 40° C./sec. or more, coiling the cooled steel sheet at a temperature of 500° C. to 700° C., and cold rolling the coiled steel sheet with the rolling reduction ratio of 50% or more.

Here, % used when describing a chemical composition always represents mass %.

A high strength cold rolled steel sheet having a high tensile strength (TS) of 440 MPa or more, excellent deep drawability due to a high r value (average r value is 1.20 or more) and excellent uniformity of mechanical property, which means mechanical properties vary little in a coil, can be obtained. Moreover, a high strength cold rolled steel sheet with excellent deep drawability having a TS of 440 MPa or more and an average r value of 1.20 or more can be stably manufactured at low cost by controlling the added content of expensive Nb to satisfy the relationship with the carbon content "(Nb/93)/(C/12): less than 0.20" by actively utilizing Ti.

Therefore, in the case where the high strength steel sheet is applied to inner and outer panels of automobile bodies, since it is possible to increase the strength of the parts which have been difficult to form by performing press forming in the past, there is a large contribution to an increase in the crash safety and a decrease in weight of automobile bodies, and since uniformity of mechanical property in a coil is good, improvement of operability can be expected when press forming is performed.

DETAILED DESCRIPTION

Our steel sheets and methods will be described in detail hereafter.

Generally, it has been considered that, to provide a high r value to a cold rolled steel sheet which is subjected to deep drawing, that is, to grow a {111} recrystallization texture, it is effective to decrease the amount of solid solution C as much as possible before cold rolling and recrystallization annealing and to decrease the grain size of the microstructure of a hot rolled steel sheet. On the other hand, in the case of a complex phase steel sheet (CP or DP steel sheet) which is manufactured by the conventional methods described above, solid solution C is required in order to form a martensite phase and a {111} recrystallization texture which is a parent phase does not grow, which results in a disadvantage of a low r value.

However, from the results of our investigations we found that a {111} recrystallization texture grows even if a martensite phase is formed, that is, there is some range of the amount of solid solution C in which the formation of a martensite phase and the growth of a {111} recrystallization texture occur at the same time. That is to say, it has become possible to increase an r value by promoting the growth of a {111} recrystallization texture after annealing has been performed and to increase strength by forming an appropriate amount of martensite phase when cooling is performed after the annealing, by controlling the C content to be lower than that of a conventional DP steel sheet which is made from low-carbon steel and to be higher than that of a conventional ultralow-carbon steel, that is, to be in the range of C: 0.010% to 0.060%, by adding appropriate amounts of Nb and Ti in accordance with the C content in order to maintain an appropriate amount of solid solution C, and by performing heating for annealing at a low average heating rate of less than 3° C./sec. in a temperature range from 700° C. to 800° C.

In addition, as known in the past, since Nb is effective in delaying recrystallization, Nb is effective in decreasing the grain size of a hot rolled steel sheet, and further, since Nb has a large affinity for carbon in steel, Nb is effective in decreasing the amount of solid solution C before cold rolling and before recrystallization annealing as a result of precipitating in the form of NbC in steel at the stage of coiling after hot rolling. Therefore, Nb contributes to increasing an r value. However, Nb is a chemical element which is expensive and decreases manufacturability as a result of increasing rolling load. Therefore, the Nb content is limited to the minimum necessary, and Ti which has as large affinity for carbon as Nb is utilized in order to decrease the amount of solid solution C. That is to say, the Nb content is controlled to satisfy the relationship with the C content "(Nb/93)/(C/12): less than 0.20", and the amount of solid solution C (C*), which is not fixed by Nb or Ti, is controlled to be 0.005 to 0.025.

Although it has been considered that the presence of solid solution C described above suppresses the growth of a { 111} recrystallization texture, a high r value is realized even with the presence of solid solution C which is necessary to form a martensite phase as a result of not all of C being fixed in the form of NbC or TiC. Although the reason why this effect is realized is not clear at present, we believe it to be because, in the case where the amount of solid solution C is controlled to be within the range described above, a positive effect of, in addition to an effect of decreasing the grain size of a hot rolled steel sheet, promoting the growth of a {111} recrystallization texture is larger than a negative effect of solute C on the formation of a {111} recrystallization texture, wherein the promoting the growth of a {111} recrystallization texture is caused by, for example, the strain accumulation induced when cold rolling is performed in the vicinity of NbC and TiC having small grain sizes which are precipitated in the matrix of a hot rolled steel sheet, and by performing heating for annealing at a low average heating rate of less than 3° C./sec. in a temperature range from 700° C. to 800° C.

As described above, it is possible to manufacture industrially and stably a high strength cold rolled steel sheet having a high r value without an increase in cost or a decrease in productivity by controlling a chemical composition to be within an appropriate range so that the amount of solid solution C (C*) is 0.005% to 0.025% and by actively utilizing Ti instead of Nb in order to significantly decrease the content of expensive Nb which increases the rolling load of hot rolling and cold rolling.

Moreover, it is possible to decrease variation in mechanical properties, in particular TS and average r value, in the longitudinal direction of the coil of a high strength cold rolled steel sheet by controlling (Nb/93+Ti*/48)/(C/12) to be 0.150 or more, controlling the rolling reduction ratios of the last and second last passes of finish rolling in hot rolling to be within appropriate ranges and controlling cooling conditions after the finish rolling and thereby promoting the precipitation of NbC and TiC at the front and tail edges of the hot rolled steel sheet which are comparatively prone to be cooled.

Subsequently, the reason for the limitations on the chemical composition of steel will be described.

C: 0.010% or More and 0.060% or Less

C is an important chemical element necessary to achieve an increase in strength, because C increases the strength of steel by solid solution strengthening and promotes formation of a complex phase consisting of a ferrite phase as a main phase and a second phase including a martensite phase. In the case where the C content is less than 0.010%, it is difficult to achieve a sufficient amount of martensite, and a TS of 440 MPa or more, which is desired, cannot be achieved. In addition, in the case where the C content is less than 0.010%, the amounts of precipitated NbC and TiC tend to be insufficient at the front edge of a coil which is comparatively prone to be cooled after the coiling of a hot rolled steel sheet, and there may be an increase in variation in mechanical properties in the coil. On the other hand, in the case where the C content is more than 0.060%, the amount of martensite is increased and the high average r value (1.20 or more) cannot be achieved. Therefore, the C content is set to be 0.010% or more and 0.060% or less, preferably 0.020% or more and 0.040% or less. It is preferable that the C content be 0.015% or more to achieve a TS of 500 MPa or more and that the C content be 0.020% or more in order to achieve a TS of 590 MPa or more.

Si: More than 0.5% and 1.5% or Less

Si is a chemical element which promotes ferrite transformation, facilitates formation of a dual phase consisting of a ferrite phase and a martensite phase by increasing the amount of the C content in an untransformed austenite phase, and has a high solid solution strengthening capability. Therefore, the Si content is more than 0.5% to achieve a TS of 440 MPa or more. On the other hand, in the case where the Si content is more than 1.5%, oxides containing Si are formed on the surface of a steel sheet, and there is a decrease in phosphatability, paint adhesion, and corrosion resistance of painted. Therefore, the Si content is more than 0.5% and 1.5% or less. It is preferable that the Si content be more than 0.8% to achieve a TS of 500 MPa or more and that the Si content be 1.0% or more to achieve a TS of 590 MPa or more.

Mn: 1.0% or More and 3.0% or Less

Since Mn is a chemical element which improves the hardenability of steel and promotes formation of a martensite phase, Mn is a chemical element effective in increasing the strength of steel. In the case where the Mn content is less than 1.0%, it is difficult to form a desirable amount of martensite, and there may be a case where a TS of 440 MPa or more cannot be achieved. On the other hand, in the case where the Mn content is more than 3.0%, there is an increase in material cost and there is a decrease in r value and weldability. Therefore, the Mn content is 1.0% or more and 3.0% or less. It is preferable that the Mn content is 1.2% or more to achieve a TS of 500 MPa or more and that the Mn content is 1.5% or more to achieve a TS of 590 MPa or more.

P: 0.005% or More and 0.100% or Less

Since P has a high solid solution strengthening capability, P is a chemical element which is effective in increasing the strength of steel. However, in the case where the P content is less than 0.005%, this effect cannot be sufficiently realized and, on the contrary, there is an increase in dephosphorization cost in a steelmaking process. On the other hand, in the case where the P content is more than 0.100%, P is segregated at grain boundaries, and there is a decrease in resistance to secondary working brittleness and weldability. Therefore, the P content is 0.005% or more and 0.100% or less, preferably 0.010% or more and 0.080% or less, more preferably 0.010% or more and 0.050% or less.

S: 0.010% or Less

S is a harmful chemical element which causes hot-shortness and a decrease in formability of a steel sheet as a result of being present as inclusions containing sulfides in steel. Therefore, it is preferable that the S content be as small as possible and, the upper limit of the S content is 0.010%, preferably 0.008% or less.

sol.Al: 0.005% or More and 0.500% or Less

Although Al is a chemical element added as a deoxidizer, Al has a solid solution strengthening capability and Al is effective in increasing the strength of steel. However, in the case where the content of Al in the form of sol.Al is less than 0.005%, the effect described above cannot be realized. On the other hand, in the case where the content of Al in the form of sol.Al is more than 0.500%, there is an increase in material cost and surface defects are caused. Therefore, the content of Al in the form of sol.Al is 0.005% or more and 0.500% or less, preferably 0.005% or more and 0.100% or less.

N: 0.0100% or Less

In the case where the N content is more than 0.0100%, an excessive amount of nitrides is formed in steel, which causes a decrease in ductility and toughness and deterioration in the surface quality of a steel sheet. Therefore, the N content is 0.0100% or less.

Nb: 0.010% or More and 0.100% or Less

Nb is a very important chemical element because Nb decreases the grain size of the microstructure of a hot rolled steel sheet, is effective in fixing some of the solid solution C in steel as a result of being precipitated in the form of NbC in a hot rolled steel sheet and, through these effects, contributes to an increase in r value. To realize this effect, it is necessary that the Nb content be 0.010% or more. On the other hand, in the case where the Nb content is more than 0.100%, there is an increase in material cost and there is a decrease in manufacturing stability due to an increase in the rolling load in hot rolling and cold rolling. In addition, as described below, a specified amount of solid solution C is necessary to form a martensite phase in a cooling process after annealing. However, in the case where the Nb content is excessively large, the formation of a martensite phase may be inhibited because all of the C in steel is fixed in the form of NbC. Therefore, the Nb content is 0.010% or more and 0.100% or less, preferably 0.010% or more and 0.075% or less, more preferably 0.010% or more and 0.050% or less.

Ti: 0.015% or More and 0.150% or Less

Ti contributes, as Nb does, to an increase in r value by fixing C and by being precipitated in the form of TiC in a hot rolled steel sheet, and therefore Ti is a very important chemical element. To realize this effect, it is necessary that the Ti content be 0.015% or more. On the other hand, in the case where the Ti content is more than 0.150%, there is an increase in material cost and there is a decrease in manufacturing stability due to an increase in rolling load of cold rolling. In addition, in the case where the Ti content is excessively large, there is a decrease in the amount of solid solution C as is the case with Nb, and the formation of a martensite phase in a cooling process after annealing is inhibited. Therefore, the Ti content is 0.015% or more and 0.150% or less.

It is necessary for the high strength steel sheet to have a chemical composition described above and also necessary for the contents of C, Nb, Ti, N, and S to satisfy the relational expressions (1), (2), and (3) below.

$$(Nb/93)/(C/12)<0.20 \quad (1)$$

$$0.005 \leq C^* \leq 0.025 \quad (2)$$

$$(Nb/93+Ti^*/48)/(C/12) \geq 0.150 \quad (3)$$

where, $C^*=C-(12/93)Nb-(12/48)Ti^*$ and $Ti^*=Ti-(48/14)N-(48/32)S$, in which $Ti-(48/14)N-(48/32)S=0(Ti^*=0)$ in the case where $Ti-(48/14)N-(48/32)S \leq 0$.

In addition, symbol M represents the content (mass %) of chemical element M in the relational expressions described above.

Nb is a chemical element which is more expensive than Ti and one of the factors that decrease manufacturing stability due to an increase in the rolling load of hot rolling. In addition, as described below, it is necessary to maintain a specified amount of solid solution C (C*), which is not fixed by Nb or Ti, in order to form a martensite phase in a cooling process after annealing in the present invention. Therefore, it is necessary to control (Nb/93)/(C/12) and C* to be within an appropriate range from the viewpoint of material cost, manufacturing stability, the microstructure of a steel sheet and the properties of a steel sheet. In addition, in the case where the atom ratio of Ti and Nb with respect to C is small, the amount of precipitated NbC and TiC and the like is insufficient at the front edge of a coil which is comparatively prone to be cooled after the coiling of a hot rolled steel sheet, there may be an increase in variation in mechanical properties in a coil. Therefore, it is necessary to appropriately control (Nb/93+Ti*/48)/(C/12) from the viewpoint of achieving uniformity of mechanical property in a coil.

Therefore, relational expressions (1), (2), and (3) which specify (Nb/93)/(C/12), C* and (Nb/93+Ti*/48)/(C/12) are the most important indicators in the present invention.

In the case where (Nb/93)/(C/12), which is the atom ratio of Nb with respect to C, is 0.20 or more, the content of expensive Nb is large, and there is a disadvantage in cost and there is an increase in the rolling load of hot rolling. Therefore, (Nb/93)/(C/12) is set to be less than 0.20.

In addition, in the case where C*, which represents the amount of solid solution C that is not fixed by Nb or Ti, is less than 0.005, a specified amount of martensite cannot be achieved, and it is difficult to achieve a TS of 440 MPa or more. On the other hand, in the case where C* is more than 0.025, formation of a {111} recrystallization texture in a ferrite phase, which is effective for increasing an r value, is inhibited, and good deep drawability cannot be achieved. Therefore, C* is 0.005 or more and 0.025 or less. It is preferable that C* be 0.020 or less to achieve an average r value of 1.30 or more and that C* be less than 0.017 to achieve an average r value of 1.40 or more.

Moreover, in the case where (Nb/93+Ti*/48)/(C/12), which is the atom ratio of Ti and Nb with respect to C, is less than 0.150, the amount of precipitated NbC and TiC and the like is insufficient at the front edge of a coil which is comparatively prone to be cooled after the coiling of a hot rolled steel sheet, and there may be an increase in variation in mechanical properties in a coil. Therefore, (Nb/93+Ti*/48)/(C/12) is 0.150 or more.

Although the target properties of the steel are achieved by using the essentially contained chemical element described above, the chemical elements described below may be added as needed in addition to the essentially contained chemical elements described above.

The steel sheet may further contain one, two or all selected from among Mo, Cr and V and/or one or two selected from Cu and Ni depending on required properties in addition to the basic chemical composition described above.

At Least One Chemical Element Selected from Among Mo, Cr and V: 0.50% or Less in Total Although Mo, Cr and V are expensive chemical elements, these are chemical elements which improve hardenability as Mn does and are effective to stably form a martensite phase. Since this effect is markedly realized in the case where the total content of these chemical elements is 0.10% or more, it is preferable that the total content of these chemical elements be 0.10% or more. On the other hand, in the case where the total content of these chemical elements is more than 0.50%, the effect described above becomes saturated and there is an increase in material cost. Therefore, in the case where these chemical elements are added, the total content of these chemical elements is set to be 0.50% or less.

One or Two Selected from Cu: 0.30% or Less and Ni: 0.30% or Less

Cu is a harmful chemical element which causes surface defects by causing cracks when hot rolling is performed. However, the negative effect of Cu on the properties of the steel sheet is small, and Cu may be added as long as the Cu content is 0.30% or less. Therefore, it is possible to utilize recycle raw material such as scrap and material cost is decreased.

Although the influence of Ni on the properties of a steel sheet is small like Cu, Ni is effective to prevent the occurrence of surface defects that is caused by adding Cu. This effect is realized by adding Ni in an amount of a half or more of the Cu content. However, in the case where Ni content is excessively large, other kind of surface defects, which is caused by the non-uniform formation of scale, may be fostered, and therefore the upper limit of Ni content is 0.30% in the case where Ni is added.

The high strength cold rolled steel sheet may further contain one or two selected from Sn and Sb and/or Ta in addition to the chemical composition described above.

One or Two Selected from Sn: 0.20% or Less and Sb: 0.20% or Less

It is preferable that Sn and Sb be added to suppress nitridation and oxidation of the surface of a steel sheet and decarburization in a region of the surface layer of a steel sheet having a thickness of about several tens of μm which is caused by oxidation. By suppressing nitridation and oxidation as described above, a decrease in the amount of martensite formed on the surface of a steel sheet is prevented, and there is improvement of fatigue resistance and surface quality. In the case where Sn or Sb is added from the viewpoint of suppressing nitridation and oxidation, the content is set to be 0.01% or more. On the other hand, in the case where the content is more than 0.20%, there is a decrease in toughness, and therefore it is preferable that the content be 0.20% or less.

Ta: 0.01% or more and 0.10% or less and the relationship $0.005 \leq C^* \leq 0.025$ is satisfied where $C^*=C-(12/93)Nb-(12/181)Ta-(12/48)Ti^*$ and where $Ti^*=Ti-(48/14)N-(48/32)S$, in which $Ti-(48/14)N-(48/32)S=0$ in the case where $Ti-(48/14)N-(48/32)S \leq 0$.

Ta is a chemical element which is effective in fixing C, similarly to Nb and Ti, as a result of being precipitated in the form of TaC in a hot rolled steel sheet and, through this effect, contributes to an increase in r value. From this viewpoint, it is preferable that the Ta content be 0.01% or more. On the other hand, in the case where the Ta content is more than 0.10%, there is an increase in cost, formation of a martensite phase in a cooling process after annealing may be inhibited, as is the case with Nb and Ti, and TaC which is precipitated in a hot rolled steel sheet causes an increase in deformation resistance when cold rolling is performed, which results in a decrease in manufacturing stability in practice. Therefore, in the case where Ta is added, the Ta content is 0.10% or less.

In the case where Ta is added, the contents of Nb, Ta, Ti, N, and S satisfy relational expression (4) below instead of relational expression (2) above.

$$0.005 \leq C^* \leq 0.025 \quad (4)$$

where, $C^*=C-(12/93)Nb-(12/181)Ta-(12/48)Ti^*$ and $Ti^*=Ti-(48/14)N-(48/32)S$, in which $Ti-(48/14)N-(48/32)S=0$ ($Ti^*=O$) in the case where $Ti-(48/14)N-(48/32)S \leq 0$.

In the case where C* in relational expression (4) is less than 0.005, a specified amount of martensite cannot be achieved, and it is difficult to achieve a TS of 440 MPa or more. On the other hand, in the case where C* is more than 0.025, the formation of a {111} recrystallization texture of a ferrite phase, which is effective in increasing the r value, is inhibited, and good deep drawability cannot be achieved. Therefore, C* is set to be 0.005 or more and 0.025 or less. It is preferable that C* be 0.20 or less to achieve an average r value of 1.30 or more and that C* be less than 0.017 to achieve an average r value of 1.40 or more.

The balance of the chemical composition other than chemical elements described above consists of Fe and inevitable impurities. However, other chemical elements may be added as long as there is not a decrease in the advantageous effect. However, since oxygen (O) has a negative effect on the quality of a steel sheet as a result of forming non-metal inclusions, it is preferable that the O content be reduced to 0.003% or less.

Subsequently, the microstructure of the high strength cold rolled steel sheet with excellent deep drawability and uniformity of mechanical property in a coil will be described.

To achieve high strength of steel sheet and good press formability (in particular deep drawability) at the same time, it is necessary that the high strength cold rolled steel sheet have a microstructure including, in area fraction with respect to the whole microstructure of the steel sheet, 70% or more of a ferrite phase and 3% or more of a martensite phase. Here, there is a case where the high strength cold rolled steel sheet has a microstructure including, for example, a pearlite phase, a bainite phase, a retained austenite phase, and carbides as the remainder of the microstructure other than ferrite and martensite phases, and this case is acceptable as long as these phases are included in an amount of 5% or less in total in area fraction.

Ferrite Phase: 70% or More in Area Fraction

A ferrite phase is a soft phase necessary to achieve good press formability, in particular deep drawability, and is utilized to increase an average r value by growing a {111} recrystallization texture. In the case where the area fraction of a ferrite phase is less than 70%, it is difficult to achieve an average r value of 1.20 or more, and good deep drawability cannot be achieved. Therefore, the area fraction of a ferrite phase is 70% or more. It is preferable that the area fraction of a ferrite phase be 80% or more to further increase an average r value. On the other hand, in the case where the area fraction of a ferrite phase is more than 97%, there is a decrease in the strength of a steel sheet, and it is difficult to achieve a TS of 440 MPa or more. Here, "ferrite" includes bainitic ferrite, which is formed as a result of transformation from austenite and which has a high dislocation density, in addition to polygonal ferrite.

Martensite Phase: 3% or More in Area Fraction

A martensite phase is a hard phase necessary to achieve high strength of a steel sheet. In the case where the area fraction of a martensite phase is less than 3%, there is a decrease in the strength of a steel sheet, and it is difficult to achieve a TS of 440 MPa or more. Therefore, the area fraction of a martensite is 3% or more. It is preferable that the area fraction of a martensite be 5% or more to achieve a TS of 500 MPa or more or 590 MPa or more. On the other hand, in the case where the area fraction is more than 30%, there is a decrease in the area fraction of a ferrite phase which is effective in increasing the r value, and it is difficult to achieve good deep drawability and bake hardenability. Therefore, the area fraction of a martensite phase is set to be 30% or less, preferably 20% or less.

The area fraction described above can be obtained using image analysis of a microstructure photographs taken using a SEM (scanning electron microscope) at a magnification of 2000 times in five microscopic fields in the L cross section (vertical cross section parallel to the rolling direction) of a steel sheet which is polished and etched using nital. In a microstructure photograph, a slightly black area is recognized as a ferrite phase, an area in which lamellar carbides are formed is recognized as a pearlite phase, an area in which carbides are formed in the form of a dot sequence was identified as a bainite phase, and white particles are recognized as martensite and retained austenite (retained γ) phases.

The high strength cold steel sheet described above has the properties described below.

TS≥440 MPa

To realize weight reduction and crash safety, at the same time, of inner and outer panels, which have been made of mild steel or steel having a tensile strength of about 340 MPa or less in the past, it is effective to reduce the weight by increasing the strength of the steel sheet and by decreasing the thickness of the steel sheet. Accordingly, the TS of the high strength steel sheet is limited to 440 MPa or more to realize this effect of weigh reduction.

Average r Value: 1.20 or More

Since a high strength steel sheet having a TS of 440 MPa or more is much poorer in terms of press formability, in particular deep drawability, than mild steel sheet, the average r value of the steel sheet is limited to 1.20 or more to provide a steel sheet for parts such as inner and outer panels and chassis which are mainly formed by performing drawing.

Subsequently, the method of manufacturing the high strength cold steel sheet with excellent deep drawability and uniformity of mechanical property in a coil (one example) will be described.

The high strength cold rolled steel sheet can be manufactured by smelting the steel having the chemical composition controlled to be within the range described above and making a slab of the steel, hot rolling the slab with the rolling reduction ratio of the last pass of finish rolling of 10% or more and the rolling reduction ratio of the second last pass of 15% or more, cold rolling the hot rolled steel sheet, and performing annealing of the cold rolled steel sheet under the conditions that heating is performed up to 800° C. to 900° C. at an average heating rate of less than 3° C./sec. in a temperature range from 700° C. to 800° C. and cooling is performed down to a cooling stop temperature of 500° C. or lower at an average cooling rate of 5° C./sec. or more.

It is preferable that the steel slab which is used in our manufacturing method be made using a continuous casting method to prevent the macro segregations of the chemical elements. However, an ingot-making method or a thin slab casting method may be used. In addition, such energy saving processes can be applied without a problem. Specifically, there are hot direct rolling in which a hot steel slab is charged into a reheating furnace without cooling the slab and hot rolled, or hot direct rolling or direct rolling in which a slab is hot rolled immediately after being held in a heat-retaining apparatus for a short duration, and a method in which a hot steel slab having a high temperature is charged into a reheating furnace and a part of the reheating process is omitted in addition to a conventional method in which a slab is cooled down to room temperature and then reheated.

It is preferable that the reheating temperature of a slab be as low as possible in order to improve deep drawability as a result of growing a {111} recrystallization texture by increasing the sizes of precipitations such as TiC. However, in the case where the reheating temperature is lower than 1000° C., there is an increased risk that troubles may occur when hot rolling is performed due to an increase in rolling load, and it is preferable that the reheating temperature of a slab be 1000° C. or higher. It is preferable that the upper limit of the reheating temperature of a slab be 1300° C. from the viewpoint of an increase in scale loss due to an increase in the amount of oxides.

The steel slab obtained as described above is subjected to hot rolling in which rough rolling and finish rolling are performed. First, the steel slab is subjected to rough rolling and made into a sheet bar. Here, there is no limitation on rough rolling conditions, and common methods may be used. In addition, from the viewpoint of making the reheating temperature of a slab lower and of preventing troubles when hot rolling is performed, it is effective to utilize a so-called "sheet bar heater" which is used to heat the sheet bar.

Subsequently, finish rolling is performed and the sheet bar is hot rolled into a hot rolled steel sheet.

The rolling reduction ratios of the last pass and the second last pass of finish rolling are controlled to be within appropriate ranges. That is to say, by controlling the rolling ratio of the last pass of finish rolling to be 10% or more, many shear bands are induced in a prior austenite grain, the grain size of a microstructure of a hot rolled steel sheet is decreased due to an increase in the number of nucleation sites of ferrite transformation, and the precipitation of NbC and TiC at the front and tail edges of a hot rolled steel coil which are comparatively prone to be cooled is promoted. A grain refinement of a hot rolled steel sheet is effective to increase the r value, because this grain refinement increases the number of nucleation sites where a {111} recrystallization texture is preferentially formed when annealing is performed after cold rolling. In addition, it is effective to promote the precipitation of NbC and TiC to improve the uniformity of mechanical property in a coil. On the other hand, in the case where the rolling reduction of the last pass is less than 10%, there is an insufficient effect of grain refinement of ferrite and there is an insufficient effect of promoting the precipitation of NbC and TiC, and there is a concern that the effects described above of increasing the r value and of improving uniformity of mechanical property in a coil cannot be realized. Therefore, the rolling reduction ratio of the last pass is 10% or more, preferably 13% or more.

Moreover, in addition to controlling the rolling reduction ratio of the last pass as described above, the rolling reduction ratio of the second last pass is 15% or more to increase the effects of increasing an r value and of improving uniformity of mechanical property in a coil. By controlling the rolling reduction of the second last pass, many shear bands are induced in a prior austenite grain due to an increased effect of strain accumulation, and there is a grain refinement of a hot rolled steel sheet due to a further increase in the number of nucleation sites of ferrite transformation. Moreover, this control is also effective in promoting precipitation of NbC and TiC, there is further increased effects of increasing the r value and improving uniformity of mechanical property in a coil. In the case where the rolling reduction of the second last pass is less than 15%, there is an insufficient effect of grain refinement of a ferrite phase and there is an insufficient effect of promoting the precipitation of NbC and TiC, and there is a concern that the effects of increasing an r value and of improving uniformity of mechanical property in a coil cannot be realized. Therefore, the rolling reduction ratio of the second last pass is set to be 15% or more, preferably 18% or more.

It is preferable that the upper limit of each of the rolling reduction ratios of the last pass and the second last pass described above be less than 40% from the viewpoint of rolling load.

In addition, although there is not a necessity to particularly limit the rolling temperatures of the last pass and the second last pass, it is preferable that the rolling temperature of the last pass be 800° C. or higher, more preferably 830° C. or higher. In addition, it is preferable that the rolling temperature of the second last pass be 980° C. or lower, more preferably 950° C. or lower.

In the case where the rolling temperature of the last pass is lower than 800° C., the transformation from non-recrystallized austenite to ferrite tends to occur, and the microstructure of a cold rolled and annealed steel sheet becomes a non-uniform microstructure in which crystal grains are elongated in the rolling direction due to the influence of the microstructure of a hot rolled steel sheet, which results in a case where there formability is decreased.

In addition, in the case where the rolling temperature of the second last pass is higher than 980° C., there is an insufficient effect of strain accumulation because of recovery, and it is difficult to decrease the grain size of the microstructure of a hot rolled steel sheet and there is an insufficient effect of promoting the precipitation of NbC and TiC, which may results in a concern that the effects of increasing the r value and of improving uniformity of mechanical property in a coil cannot be realized.

It is preferable to start cooling the hot rolled steel sheet after hot rolling has been performed as descried above within 3 seconds after finish rolling at an average cooling rate of 40° C./sec. or more down to a temperature of 720° C. or lower and to coil the cooled steel sheet at a temperature of 500° C. to 700° C. to increase an r value due to decreasing grain size and to realize uniformity of mechanical property in a coil due to promoting the precipitation of NbC and TiC.

In the case where the time before starting cooling is more than 3 seconds, where the average cooling rate is less than 40° C./sec., or where the cooling stop temperature is higher than 720° C., there is an excessive increase in the grain size of a microstructure of a hot rolled steel sheet, and there may be a case where the effect of increasing an r value is not obtained.

In addition, in the case where the coiling temperature is higher than 700° C., there is an excessive increase in the grain size of a microstructure of a hot rolled steel sheet, and there is a concern that there may be a decrease in strength after cold rolling and annealing and there may be a negative effect on an increase in r value. On the other hand, in the case where the coiling temperature is lower than 500° C., it is difficult to precipitate NbC and TiC, and there is an increase in the amount of solid solution C, which results in a case where there is a disadvantage in increasing the r value and in realizing uniformity of mechanical property in a coil.

Subsequently, pickling is appropriately performed, and then, cold rolling is performed in order to make a cold rolled steel sheet. Pickling is not indispensable and may be performed as needed. In addition, in the case where pickling is performed, it may be performed under normal conditions.

Although there is no limitation on cold rolling conditions as long as a cold rolled steel sheet has desired size and shape, it is preferable that the rolling reduction ratio be at least 50% or more in cold rolling. High rolling reduction ratio of cold rolling is effective in increasing the r value, and in the case where the rolling reduction ratio is less than 50%, the {111} recrystallization texture of a ferrite phase does not grow, and it may be difficult to achieve good deep drawability. On the other hand, although the r value increases with an increased rolling reduction ratio in the present invention, in the case where the reduction ratio is more than 90%, this effect becomes saturated and there is an increase in load on rolls when rolling is performed, which results in a concern that there may be troubles in rolling, it is preferable that the upper limit of the rolling ratio of cold rolling be 90%.

Subsequently, an annealing process, which is an important factor, will be described in detail.

The cold rolled steel sheet is subjected to annealing to achieve the desired strength and deep drawability. For this purpose, it is necessary to heat the steel sheet up to a temperature of 800° C. to 900° C. at an average heating rate of less than 3° C./sec. in a temperature range from 700° C. to 800° C. and to thereafter cool the steel sheet down to a temperature of 500° C. or lower at an average cooling rate of 5° C./sec. or more.

NbC and TiC are precipitated in steel at the stage of hot rolled steel sheet, and the recrystallization temperature of the steel sheet after cold rolling has been performed is comparatively high. Therefore, it is necessary to heat the cold rolled steel sheet at a low average heating rate of less than 3° C./sec. in a temperature range from 700° C. to 800° C. in order to grow a {111} recrystallization texture, which is effective in increasing the r value, by promoting recrystallization and to suppress variation in mechanical properties by achieving a uniform recrystallized microstructure. In the case where the average cooling rate is 3° C./sec. or more, there is insufficient growth of a {111} recrystallization texture, and it is difficult to increase the r value and there may be a decrease in formability and the occurrence of variation in mechanical properties due to a non-uniform microstructure. It is preferable that the average heating rate be 0.5° C./sec. or more to increase productivity.

To achieve the steel sheet having a dual phase including desired area fractions of ferrite and a martensite phases after annealing, it is necessary that the annealing temperature be within the range in which a dual phase of ferrite and martensite phases are formed and it is necessary to suppress variation in mechanical properties by forming a uniform recrystallized microstructure. Therefore, the annealing temperature is 800° C. to 900° C. In the case where the annealing temperature is lower than 800° C., a desired amount of martensite cannot be achieved after cooling following the annealing and recrystallization is not sufficiently completed during annealing, and there may be a case where an average r value of 1.20 or more cannot be achieved due to the insufficient growth of a {111] recrystallization texture and where there may be a decrease in formability and variation in mechanical properties due to a non-uniform microstructure. On the other hand, in the case where the annealing temperature is higher than 900° C., the temperature is within the range in which a single phase of austenite is formed, and the second phase (martensite phase, bainite phase, or pearlite phase) is formed in an amount more than necessary when cooling is performed at some cooling rate afterwards, desired area fraction of a ferrite phase cannot be achieved, which results in a good r value being not achieved, and which results in problems in that there is a decrease in productivity and there is an increase in energy cost. Therefore, the annealing temperature is 800° C. to 900° C., preferably 820° C. to 880° C.

It is preferable that the soaking time of annealing be 15 seconds or more to progress the concentration of chemical elements such as C in an austenite phase and in order to promote sufficient growth of a {111} recrystallization texture of a ferrite phase. On the other hand, in the case where the soaking time is more than 300 seconds, there is an excessive increase in grain size, which results in a concern that there are negative influences on the various properties of a steel sheet such as decrease in strength and deterioration in the surface quality of a steel sheet. Therefore, it is preferable that the soaking time of annealing be 15 seconds to 300 seconds, more preferably 15 seconds to 200 seconds.

It is necessary that the steel sheet, in which recrystallization has been completed at the annealing temperature described above, be cooled down to a temperature of 500° C. or lower from the annealing temperature at an average cooling rate of 5° C./sec. or more. In the case where the average cooling rate is less than 5° C./sec., it is difficult to achieve, in area fraction with respect to the whole microstructure of the steel sheet, 3% or more of a martensite phase, and the desired strength (TS of 440 MPa or more) cannot be achieved. In addition, in the case where the cooling stop temperature is higher than 500° C., there is also a concern that 3% or more of a martensite phase, in area fraction, cannot be achieved. It is preferable that the average cooling rate be 8° C./sec. or more, more preferably 10° C./sec. or more. In addition, it is preferable that the cooling stop temperature be 400° C. to 450° C. It is preferable that the upper limit of the average cooling rate be 100° C./sec., because, in the case where the average cooling rate is more than 100° C./sec., special apparatuses such as a water cooler is necessary, which results in an increase in manufacturing cost and a concern that there may be deterioration in the shape of the steel sheet.

Although there is no limitation on cooling conditions after cooling has been performed down to the cooling stop temperature, it is preferable that cooling is performed at an average cooling rate of 0.2° C./sec. to 10° C./sec. in a temperature range from the cooling stop temperature to 200° C. in order to recover ductility and toughness by appropriately progressing the tempering of a martensite phase. That is to say, in the case where the average cooling rate in the temperature range described above is less than 0.2° C./sec., tempering of a martensite phase excessively progresses, and there is concern that desired strength cannot be achieved. On the other hand, in the case where the average cooling rate in the temperature range described above is more than 10° C./sec., tempering of a martensite phase does not sufficiently progress, a sufficient effect of recovering ductility and toughness cannot be expected. It is more preferable that the average cooling rate be 0.5° C./sec. or more and 6° C./sec. or less.

The cold rolled steel sheet, which has been manufactured as described above, may be subjected to, for example, skin pass rolling and leveling to correct the shape of the steel sheet and to control the surface roughness of the steel sheet. It is preferable that, in the case where skin pass rolling is performed, the elongation ratio be about 0.3% or more and 1.5% or less.

As described above, the high strength cold rolled steel sheet with excellent deep drawability and uniformity of mechanical property in a coil can be obtained. The steel sheet may be subjected to surface treatment such as electrical plating. Examples of plating treatment include zinc containing plating treatment, in which pure zinc or zinc-based alloy is used, and Al containing plating treatment, in which Al or Al-based alloy is used.

EXAMPLE 1

Our steel sheets and methods will be described further in detail with reference to examples hereafter.

The steels having chemical compositions given in Table 1 were smelted using a converter and made into slabs using a continuous casting method. These steel slabs were made into hot rolled steel sheets having a thickness of 4.0 mm by reheating the steel slabs at a temperature of 1220° C., by hot rolling the reheated slabs and by coiling the hot rolled steel sheet. Here, the rolling temperatures and rolling reduction ratios of the final pass and second final pass of the finish rolling of the hot rolling described above, the average cooling rates from the cooling start temperatures to a temperature of 720° C. after finish rolling and the coiling temperatures are given in Table 2. In addition, the time from the end of the finish rolling to the start of cooling was 3 seconds or less. Subsequently, the hot rolled steel sheets obtained as described above were subjected to pickling, and the pickled steel sheets were cold rolled under the conditions described in Table 2 into cold rolled steel sheets having a thickness of 1.2 mm. Then, the cold rolled steel sheets were subjected to continuous annealing under the conditions given in Table 2, and then, were subjected to skin pass rolling under the condition that an elongation ratio was 0.5% and were made into cold rolled steel sheets (products).

Using a sample which was cut out of the middle part (M part) in the longitudinal direction of the cold rolled steel sheet obtained as described above, microstructure observation and a tensile test were carried out by the methods described below to identify the microstructure of the steel sheet and in order to determine the area fractions of ferrite and martensite phases, a TS, an elongation (hereinafter, also represented by EL), and an average r value. In addition, samples were also cut out of the top part in the longitudinal direction of the cold rolled steel coil (T part at the position located at 2 m from the front edge of the coil) and the bottom part in the longitudinal direction of the cold rolled steel coil (B part at the position located at 2 m from the tail edge of the coil), and the difference between the maximum and minimum values of a TS among the values for the TS of the T part, M part, and B part of the coil were determined, defined as the variation amount of TS and represented by ΔTS. Moreover, the difference between the maximum and minimum values of an elongation among the values for the elongation of the T part, M part, and B part of the coil were determined, defined as the variation amount of a elongation and represented by DEL, and the difference between the maximum and minimum values of an average r value among the values for the average r value of the T part, M part, and B part of the coil were determined, defined as the variation amount of an r value and represented by Δaverage r value to evaluate material uniformity in the coil.

Microstructure Observation

The microstructure of the cold rolled steel sheet was identified and the area fractions of ferrite and martensite phases were determined by using a microstructure photograph (SEM photograph) which was taken using a scanning electron microscope (SEM) at a magnification of 2000 times in an L cross section (vertical cross section in the rolling direction of the steel sheet) of a sample for microstructure observation which was prepared by cutting out of the cold rolled steel sheet, by mechanically polishing and by etching using a nital solution. To identify the microstructure of the steel sheet using the photograph described above, a slightly black area was identified as a ferrite phase, an area in which carbides were formed in a lamellar shape was identified as a pearlite phase, an area in which carbides are formed in the form of a dot sequence was identified as a bainite phase and white particles were identified as martensite and retained austenite (retained γ) phases. Moreover, after performing tempering treatment on the sample described above under the conditions that the treating temperature was 250° C. and the duration was 4 hours, using a microstructure photograph which was taken similarly for the sample before the tempering treatment, an area in which carbides were formed in a lamellar shape was identified as an area which was identified as a perlite phase before the treatment, an area in which carbides are formed in the form of a dot sequence was identified as an area which was identified as a bainite or martensite phase before the treatment and the retained white fine particles were identified as a retained γ phase, and then the area fractions of these phases were determined. Then, the area fraction of a martensite phase was determined by the difference between the area fraction of the white particles which was determined before the treatment and the area fraction of the retained γ phase. The area fraction of each phase was determined using image analysis software (Digital Image Pro Plus ver. 4.0, produced by Microsoft Corporation) after taking the binarized image of each phase whose area was colored on each transparent OHP sheet.

Tensile Test

A tensile test was carried out in accordance with JIS Z 2241 (1998) using a JIS No. 5 tensile test piece (JIS Z 2201) which was cut out of the cold rolled steel sheet so that the tensile direction was at an angle of 90° (C. direction) to the rolling direction in order to determine a TS and a total elongation EL. In addition, the differences between the maximum and minimum values of a TS and an EL in the longitudinal direction of the coil were respectively determined and represented by ΔTS and ΔEL.

Average r Value

An average r value (average plastic strain ratio) was calculated in accordance with JIS Z 2254 (2008) from the values of the true strains in the width and thickness directions which were determined by applying a uniaxial tensile strain of 10% on JIS No. 5 tensile test pieces which were cut out of the obtained cold rolled steel sheet so that the tensile directions were respectively at angles of 0° (L direction), 45° (D direction) and 90° (C. direction). In addition, the differences between the maximum and minimum values of an average r value in the longitudinal direction of the coil were determined and represented by Δaverage r value. The obtained results are given in Table 3.

TABLE 1

| Steel Code | Chemical Composition (mass %) | | | | | | | | | | | |
|---|---|---|---|---|---|---|---|---|---|---|---|---|
| | C | Si | Mn | P | S | sol. Al | N | Nb | Ti | Ta | Others | (Nb/93)/(C/12) |
| A | 0.007 | 0.2 | 1.7 | 0.035 | 0.002 | 0.033 | 0.0021 | 0.011 | 0.016 | — | — | 0.20 |
| B | 0.016 | 0.7 | 0.8 | 0.044 | 0.001 | 0.031 | 0.0026 | 0.007 | 0.015 | — | — | 0.06 |
| C | 0.015 | 0.9 | 1.1 | 0.038 | 0.002 | 0.028 | 0.0031 | 0.016 | 0.016 | — | Mo: 0.11%<br>Cr: 0.10%<br>V: 0.22% | 0.14 |
| D | 0.017 | 1.2 | 1.4 | 0.043 | 0.004 | 0.029 | 0.0025 | 0.019 | 0.018 | — | — | 0.14 |
| E | 0.021 | 1.3 | 1.6 | 0.055 | 0.002 | 0.028 | 0.0031 | 0.021 | 0.017 | — | Cu: 0.21%<br>Ni: 0.12% | 0.13 |
| F | 0.023 | 1.3 | 2.2 | 0.031 | 0.002 | 0.036 | 0.0025 | 0.031 | 0.029 | — | — | 0.17 |
| G | 0.029 | 1.2 | 2.1 | 0.025 | 0.002 | 0.042 | 0.0028 | 0.032 | 0.047 | — | — | 0.14 |
| H | 0.025 | 1.3 | 2.0 | 0.022 | 0.003 | 0.049 | 0.0023 | 0.027 | 0.035 | — | — | 0.14 |
| I | 0.030 | 1.3 | 2.2 | 0.029 | 0.002 | 0.035 | 0.0033 | 0.028 | 0.041 | — | — | 0.12 |
| J | 0.038 | 1.1 | 2.1 | 0.032 | 0.003 | 0.031 | 0.0035 | 0.039 | 0.049 | — | — | 0.13 |
| K | 0.039 | 1.1 | 2.0 | 0.042 | 0.002 | 0.028 | 0.0033 | 0.025 | 0.079 | — | — | 0.08 |
| L | 0.041 | 1.0 | 2.1 | 0.039 | 0.003 | 0.044 | 0.0028 | 0.061 | 0.096 | — | — | 0.19 |
| M | 0.049 | 1.4 | 2.0 | 0.034 | 0.003 | 0.029 | 0.0022 | 0.053 | 0.122 | — | — | 0.14 |
| N | 0.059 | 1.5 | 2.0 | 0.024 | 0.001 | 0.036 | 0.0025 | 0.108 | 0.011 | — | — | 0.24 |
| O | 0.066 | 1.7 | 2.1 | 0.011 | 0.001 | 0.033 | 0.0015 | 0.066 | 0.008 | — | — | 0.13 |
| P | 0.017 | 0.7 | 1.3 | 0.032 | 0.002 | 0.033 | 0.0026 | 0.020 | 0.015 | 0.04 | Sn: 0.02 | 0.15 |
| Q | 0.021 | 0.8 | 1.8 | 0.042 | 0.005 | 0.039 | 0.0031 | 0.018 | 0.055 | — | — | 0.11 |
| R | 0.023 | 0.9 | 2.0 | 0.050 | 0.005 | 0.043 | 0.0028 | 0.021 | 0.045 | 0.05 | Sn: 0.02<br>Sb: 0.03 | 0.12 |
| S | 0.035 | 1.1 | 2.2 | 0.048 | 0.005 | 0.036 | 0.0025 | 0.025 | 0.082 | — | — | 0.09 |
| T | 0.030 | 1.0 | 2.1 | 0.033 | 0.003 | 0.033 | 0.0019 | 0.022 | 0.071 | 0.03 | Sn: 0.03 | 0.09 |
| U | 0.049 | 0.9 | 2.0 | 0.052 | 0.005 | 0.042 | 0.0035 | 0.015 | 0.115 | 0.02 | Sn: 0.03 | 0.04 |
| V | 0.058 | 1.1 | 2.2 | 0.043 | 0.003 | 0.033 | 0.0029 | 0.081 | 0.108 | 0.09 | Sn: 0.08<br>Sb: 0.03 | 0.18 |

| Steel Code | Chemical Composition (mass %) | | | | Note |
|---|---|---|---|---|---|
| | Ti*=Ti-(48/14)N-(48/32)S | C*(=C-(12/93)Nb-(12/48)Ti*) | C*(=C-(12/93)Nb-(12/181)Ta-(12/48)Ti*) | (Nb/93 + Ti*/48)/(C/12) | |
| A | 0.006 | 0.004 | — | 0.417 | Comparative Example |
| B | 0.005 | 0.014 | — | 0.135 | Comparative Example |
| C | 0.002 | 0.012 | — | 0.171 | Example |
| D | 0.003 | 0.014 | — | 0.188 | Example |
| E | 0.003 | 0.018 | — | 0.165 | Example |
| F | 0.017 | 0.015 | — | 0.359 | Example |
| G | 0.034 | 0.016 | — | 0.435 | Example |
| H | 0.023 | 0.016 | — | 0.369 | Example |
| I | 0.027 | 0.020 | — | 0.345 | Example |

TABLE 1-continued

| | | | | | |
|---|---|---|---|---|---|
| J | 0.033 | 0.025 | — | 0.350 | Example |
| K | 0.065 | 0.020 | — | 0.499 | Example |
| L | 0.082 | 0.013 | — | 0.692 | Example |
| M | 0.110 | 0.015 | — | 0.701 | Example |
| N | 0.001 | 0.045 | — | 0.240 | Comparative Example |
| O | 0.001 | 0.057 | — | 0.133 | Comparative Example |
| P | 0.003 | — | 0.011 | 0.196 | Example |
| Q | 0.037 | 0.009 | — | 0.551 | Example |
| R | 0.028 | — | 0.010 | 0.422 | Example |
| S | 0.066 | 0.015 | — | 0.564 | Example |
| T | 0.060 | — | 0.010 | 0.595 | Example |
| U | 0.096 | — | 0.022 | 0.529 | Example |
| V | 0.094 | — | 0.018 | 0.585 | Example |

TABLE 2

| | | Hot Rolling Process | | | | | | Cold |
|---|---|---|---|---|---|---|---|---|
| Steel Sheet No. | Steel Code | Rolling Temperature of Second Last Pass (° C.) | Rolling Reduction of Second Last Pass (%) | Rolling Temperature of Last Pass (° C.) | Rolling Reduction of Last Pass (%) | Cooling Rate after Finish Rolling (° C./sec.)* | Coiling Temperature (° C.) | Rolling Process Rolling Reduction (%) |
| 1 | A | 970 | 18 | 870 | 14 | 20 | 600 | 70 |
| 2 | B | 970 | 18 | 870 | 14 | 20 | 600 | 70 |
| 3 | C | 970 | 18 | 870 | 14 | 20 | 600 | 70 |
| 4 | D | 970 | 18 | 870 | 14 | 20 | 600 | 70 |
| 5 | E | 970 | 18 | 870 | 14 | 20 | 600 | 70 |
| 6 | F | 970 | 18 | 870 | 14 | 20 | 600 | 70 |
| 7 | G | 970 | 18 | 870 | 14 | 20 | 600 | 70 |
| 8 | H | 970 | 18 | 870 | 14 | 20 | 600 | 70 |
| 9 | I | 970 | 18 | 870 | 14 | 20 | 600 | 70 |
| 10 | J | 970 | 18 | 870 | 14 | 20 | 600 | 70 |
| 11 | K | 970 | 18 | 870 | 14 | 20 | 600 | 70 |
| 12 | L | 970 | 18 | 870 | 14 | 20 | 600 | 70 |
| 13 | M | 970 | 18 | 870 | 14 | 20 | 600 | 70 |
| 14 | N | 970 | 18 | 870 | 14 | 20 | 600 | 70 |
| 15 | O | 970 | 18 | 870 | 14 | 20 | 600 | 70 |
| 16 | P | 970 | 18 | 870 | 14 | 20 | 600 | 70 |
| 17 | Q | 970 | 18 | 870 | 14 | 20 | 600 | 70 |
| 18 | R | 970 | 18 | 870 | 14 | 20 | 600 | 70 |
| 19 | S | 970 | 18 | 870 | 14 | 20 | 600 | 70 |
| 20 | T | 970 | 18 | 870 | 14 | 20 | 600 | 70 |
| 21 | U | 970 | 18 | 870 | 14 | 20 | 600 | 70 |
| 22 | V | 970 | 18 | 870 | 14 | 20 | 600 | 70 |

| | | Annealing Process | | | | | | |
|---|---|---|---|---|---|---|---|---|
| Steel Sheet No. | Steel Code | Average Heating Rate from 700° C. to 800° C. (° C./sec.) | Annealing Temperature (° C.) | Soaking Time (sec.) | Cooling Stop Temperature (° C.) | Average Cooling Rate from Anneaing Temperature to Cooling Stop Temperature (° C./sec.) | Average Cooling Rate from Cooling Stop Temperature to 200° C. (° C./sec.) | Skin Pass Rolling Process Elongation Ratio (%) |
| 1 | A | 1 | 850 | 150 | 400 | 20 | 0.5 | 0.5 |
| 2 | B | 1 | 860 | 150 | 400 | 20 | 0.5 | 0.5 |
| 3 | C | 1 | 850 | 150 | 400 | 20 | 0.5 | 0.5 |
| 4 | D | 1 | 860 | 150 | 400 | 20 | 0.5 | 0.5 |
| 5 | E | 1 | 860 | 150 | 400 | 20 | 0.5 | 0.5 |
| 6 | F | 1 | 860 | 150 | 400 | 20 | 0.5 | 0.5 |
| 7 | G | 1 | 850 | 150 | 400 | 20 | 0.5 | 0.5 |
| 8 | H | 1 | 860 | 150 | 400 | 20 | 0.5 | 0.5 |
| 9 | I | 1 | 850 | 150 | 400 | 20 | 0.5 | 0.5 |
| 10 | J | 1 | 860 | 150 | 400 | 20 | 0.5 | 0.5 |
| 11 | K | 1 | 860 | 150 | 400 | 20 | 0.5 | 0.5 |
| 12 | L | 1 | 870 | 150 | 400 | 20 | 0.5 | 0.5 |
| 13 | M | 1 | 860 | 150 | 400 | 20 | 0.5 | 0.5 |
| 14 | N | 1 | 860 | 150 | 400 | 20 | 0.5 | 0.5 |
| 15 | O | 1 | 870 | 150 | 400 | 20 | 0.5 | 0.5 |
| 16 | P | 1 | 850 | 150 | 400 | 20 | 0.5 | 0.5 |

TABLE 2-continued

| | | | | | | | | |
|---|---|---|---|---|---|---|---|---|
| 17 | Q | 1 | 850 | 150 | 400 | 20 | 0.5 | 0.5 |
| 18 | R | 1 | 850 | 150 | 400 | 20 | 0.5 | 0.5 |
| 19 | S | 1 | 850 | 150 | 400 | 20 | 0.5 | 0.5 |
| 20 | T | 1 | 850 | 150 | 400 | 20 | 0.5 | 0.5 |
| 21 | U | 1 | 850 | 150 | 400 | 20 | 0.5 | 0.5 |
| 22 | V | 1 | 850 | 150 | 400 | 20 | 0.5 | 0.5 |

*Average Cooling Rate from Cooling Start Temperature to 720° C. after Finish Rolling

TABLE 3

| Steel | | Microstructure of Steel | | | Mechanical Properties | | | | | | |
|---|---|---|---|---|---|---|---|---|---|---|---|
| Sheet No. | Steel Code | Ferrite Area Fraction (%) | Martensite Area Fraction (%) | Others* | TS(MPa) | ΔTS (MPa) | El (%) | ΔEl (%) | Average r value | ΔAverage r value | Note |
| 1 | A | 97 | 1 | P | 405 | 26 | 44.4 | 2.9 | 1.83 | 0.26 | Comparative Example |
| 2 | B | 97 | 2 | P | 436 | 25 | 41.0 | 2.5 | 1.59 | 0.25 | Comparative Example |
| 3 | C | 93 | 4 | P | 497 | 16 | 36.2 | 1.6 | 1.62 | 0.15 | Example |
| 4 | D | 89 | 8 | P | 534 | 13 | 33.7 | 1.3 | 1.58 | 0.12 | Example |
| 5 | E | 90 | 10 | — | 595 | 16 | 30.3 | 1.3 | 1.39 | 0.17 | Example |
| 6 | F | 89 | 11 | — | 598 | 12 | 30.1 | 1.2 | 1.53 | 0.12 | Example |
| 7 | G | 87 | 12 | P, B | 607 | 8 | 29.7 | 0.8 | 1.48 | 0.08 | Example |
| 8 | H | 84 | 12 | P, B | 620 | 12 | 29.0 | 1.2 | 1.53 | 0.11 | Example |
| 9 | I | 80 | 15 | P, B | 652 | 10 | 27.6 | 1.0 | 1.38 | 0.11 | Example |
| 10 | J | 79 | 19 | P, B | 715 | 14 | 25.2 | 1.4 | 1.22 | 0.13 | Example |
| 11 | K | 81 | 17 | P, B | 700 | 12 | 25.7 | 1.3 | 1.35 | 0.11 | Example |
| 12 | L | 86 | 9 | P, B | 594 | 6 | 30.3 | 0.6 | 1.59 | 0.07 | Example |
| 13 | M | 85 | 11 | P, B | 602 | 9 | 29.9 | 1.0 | 1.51 | 0.10 | Example |
| 14 | N | 62 | 34 | B, γ | 790 | 12 | 22.8 | 1.1 | 0.77 | 0.10 | Comparative Example |
| 15 | O | 64 | 31 | B, γ | 763 | 35 | 23.6 | 3.2 | 0.98 | 0.04 | Comparative Example |
| 16 | P | 90 | 6 | P, B | 506 | 18 | 35.5 | 1.8 | 1.69 | 0.16 | Example |
| 17 | Q | 92 | 5 | P, B | 488 | 9 | 36.9 | 0.8 | 1.75 | 0.10 | Example |
| 18 | R | 93 | 5 | P, B | 490 | 12 | 36.7 | 1.1 | 1.73 | 0.12 | Example |
| 19 | S | 86 | 11 | P, B | 598 | 9 | 30.1 | 0.9 | 1.55 | 0.09 | Example |
| 20 | T | 92 | 5 | P, B | 482 | 8 | 37.3 | 0.8 | 1.72 | 0.09 | Example |
| 21 | U | 80 | 18 | B, γ | 727 | 10 | 24.8 | 1.1 | 1.28 | 0.10 | Example |
| 22 | V | 84 | 14 | B, γ | 654 | 8 | 27.5 | 0.9 | 1.38 | 0.10 | Example |

*P; pearlite, B; bainite, γ; retained austenite

Table 3 indicates our chemical compositions and manufacturing methods as steel sheets Nos. 3 through 13 and Nos. 16 through 22 and had a TS of 440 MPa or more and an average r value of 1.20 or more, which means that these steel sheets are the cold rolled steel sheets which satisfy the limitations on strength and deep drawability. In addition, these steel sheets had a ΔTS of less than 20 MPa, a ΔEL of less than 2.0%, and a Δaverage r value of less than 0.20, which means that these steel sheets are the cold rolled steel sheets which are excellent in terms of uniformity of mechanical property in a coil. In particular, steel sheets Nos. 5, 9, 11, and 22, which contained solid solution C (C*) in an amount of 0.20 or less, had an average r value of 1.30 or more, and, moreover, steel sheets Nos. 3, 4, 6 through 8, 12, 13, and 16 through 20, which had a C* of less than 0.017, had an average r value of 1.40 or more, which means that these steel sheets have significantly good deep drawability.

On the other hand, in the case of comparative example No. 1, since the contents of C and Si and a value of C* were respectively out of our ranges, the desired amount of a martensite phase was not achieved, which resulted in a TS of less than 440 MPa, and since the C content was less than 0.010%, ΔTS, ΔEL and Δaverage r value, which are the indicators of variation in mechanical properties in a coil, were larger than our ranges due to the variation of the amounts of NbC and TiC which were precipitated after the coiling of hot rolling had been performed. In addition, in the case of comparative example No. 2, since the Mn content was out of our range, the desired amount of a martensite phase was not achieved, which resulted in a TS of less than 440 MPa, and since (Nb/93+Ti*/48)/(C/12) was less than 0.150, ΔTS, ΔEL and Δaverage r value, which are the indicators of a variation in mechanical properties in a coil, were larger than our ranges due to the variation of the amounts of NbC and TiC which were precipitated after the coiling of hot rolling had been performed. In addition, in the case of the steel sheet of comparative examples Nos. 14 and 15, since C* was larger than our range, an average r value was less than 1.20 due to a small area fraction of a ferrite phase, which is effective for increasing an r value, and since, in the case of No. 15, (Nb/93+Ti*/48)/(C/12) was less than 0.150, ΔTS and ΔEL were larger than our ranges.

EXAMPLE 2

The steels having the chemical compositions D, G and L given in Table 1 were smelted using a converter and made into steel slabs using a continuous casting method. These steel slabs were made into hot rolled steel sheets having a thickness of 4.0 mm by reheating the steel slabs at a temperature of 1220° C., by hot rolling the reheated slabs and by coiling the hot rolled steel sheet. The rolling temperatures and rolling reduction ratios of the final pass and second final pass of the finish rolling of the hot rolling described above, the average cooling rates from the cooling start temperatures to a temperature of 720° C. after finish rolling had been performed and the coiling temperatures are given in Table 4. In addition, the time from the end of the finish rolling to the start of cooling was 3 seconds or less.

Subsequently, the hot rolled steel sheets obtained as described above were subjected to pickling, and the pickled steel sheets were cold rolled into cold rolled steel sheets having a thickness of 1.2 mm. Then, the cold rolled steel sheets were subjected to continuous annealing under the conditions given in Table 4, and then, were subjected to skin pass rolling under the condition that a elongation ratio was 0.5% and were made into cold rolled steel sheets (products).

Using a sample which was cut out of the middle part (M part) in the longitudinal direction of the obtained cold rolled steel sheet similarly to EXAMPLE 1, microstructure observation and a tensile test were carried out in order to determine the area fractions of ferrite and martensite phases, a TS, an elongation, and an average r value. In addition, the variation amounts of a TS, an EL, and an r value in the longitudinal direction of the coil, that is, a ΔTS, a ΔEL, and a Δaverage r value were evaluated.

The results of the observation described above are given in Table 5.

TABLE 4

| | | Hot Rolling Process | | | | | | Cold |
|---|---|---|---|---|---|---|---|---|
| Steel Sheet No. | Steel Code | Rolling Temperature of Second Last Pass (° C.) | Rolling Reduction of Second Last Pass (%) | Rolling Temperature of Last Pass (° C.) | Rolling Reduction of Last Pass (%) | Cooling Rate after Finish Rolling (° C./sec.)* | Coiling Temperature (° C.) | Rolling Process Rolling Reduction (%) |
| 23 | D | 970 | 18 | 870 | 14 | 20 | 600 | 70 |
| 24 | | 970 | 15 | 870 | 10 | 20 | 600 | 70 |
| 25 | | 970 | 20 | 870 | 15 | 40 | 600 | 70 |
| 26 | | 920 | 20 | 850 | 15 | 80 | 620 | 70 |
| 27 | G | 970 | 18 | 870 | 14 | 20 | 600 | 70 |
| 28 | | 990 | 15 | 840 | 10 | 20 | 600 | 70 |
| 29 | | 970 | 18 | 780 | 14 | 20 | 600 | 70 |
| 30 | | 970 | 18 | 870 | 14 | 80 | 580 | 70 |
| 31 | | 970 | 12 | 870 | 7 | 20 | 600 | 70 |
| 32 | | 970 | 15 | 870 | 10 | 20 | 480 | 70 |
| 33 | | 970 | 15 | 870 | 10 | 20 | 710 | 70 |
| 34 | | 970 | 18 | 870 | 14 | 20 | 620 | 70 |
| 35 | | 970 | 18 | 870 | 14 | 20 | 620 | 70 |
| 36 | | 950 | 15 | 870 | 10 | 20 | 550 | 70 |
| 37 | | 950 | 15 | 870 | 10 | 20 | 550 | 70 |
| 38 | | 930 | 15 | 850 | 15 | 20 | 650 | 70 |
| 39 | L | 970 | 18 | 870 | 14 | 20 | 600 | 70 |
| 40 | | 930 | 15 | 850 | 10 | 20 | 600 | 70 |
| 41 | | 970 | 15 | 870 | 15 | 20 | 600 | 70 |

| | Annealing Process | | | | | | |
|---|---|---|---|---|---|---|---|
| Steel Sheet No. | Average Heating Rate from 700° C. to 800° C. (° C./sec.) | Annealing Temperature (° C.) | Soaking Time (sec.) | Cooling Stop Temperature (° C./sec.) | Average Cooling Rate from Anneaing Temperature to Cooling Stop Temperature (° C./sec.) | Average Cooling Rate from Cooling Stop Temperature to 200° C. (° C./sec.) | Skin Pass Rolling Process Elongation Ratio (%) |
| 23 | 1 | 860 | 150 | 400 | 20 | 0.5 | 0.5 |
| 24 | 2 | 850 | 150 | 400 | 20 | 1.5 | 0.5 |
| 25 | 1 | 860 | 150 | 450 | 10 | 1.0 | 0.5 |
| 26 | 2 | 860 | 150 | 450 | 10 | 2.0 | 0.5 |
| 27 | 1 | 850 | 150 | 400 | 20 | 0.5 | 0.5 |
| 28 | 1 | 850 | 80 | 450 | 10 | 1.0 | 0.5 |
| 29 | 1 | 850 | 150 | 400 | 20 | 0.5 | 0.5 |
| 30 | 1 | 840 | 80 | 450 | 20 | 1.5 | 0.5 |
| 31 | 2 | 850 | 150 | 450 | 10 | 2.0 | 0.5 |
| 32 | 2 | 840 | 150 | 450 | 20 | 0.5 | 0.5 |
| 33 | 2 | 850 | 150 | 450 | 15 | 0.5 | 0.5 |
| 34 | 2 | 780 | 150 | 400 | 15 | 0.5 | 0.5 |
| 35 | 2 | 910 | 150 | 400 | 15 | 0.5 | 0.5 |
| 36 | 1 | 860 | 10 | 450 | 10 | 1.0 | 0.5 |
| 37 | 1 | 860 | 350 | 450 | 10 | 1.0 | 0.5 |
| 38 | 2 | 830 | 150 | 500 | 3 | 0.5 | 0.5 |
| 39 | 1 | 870 | 150 | 400 | 20 | 0.5 | 0.5 |
| 40 | 1 | 850 | 50 | 450 | 10 | 3.0 | 0.5 |
| 41 | 5 | 850 | 50 | 400 | 10 | 3.0 | 0.5 |

*Average Cooling Rate from Cooling Start Temperature to 720° C. after Finish Rolling

TABLE 5

| Steel Sheet No. | Steel Code | Microstructure of Steel: Ferrite Area Fraction (%) | Martensite Area Fraction (%) | Others* | Mechanical Properties: TS (MPa) | ΔTS (MPa) | El (%) | ΔEl (%) | Average r value | ΔAverage r value | Note |
|---|---|---|---|---|---|---|---|---|---|---|---|
| 23 | D | 89 | 8 | P | 534 | 13 | 33.7 | 1.3 | 1.58 | 0.12 | Example |
| 24 | | 90 | 9 | P, B | 561 | 15 | 32.1 | 1.5 | 1.57 | 0.15 | Example |
| 25 | | 90 | 9 | P, B | 569 | 6 | 31.6 | 0.5 | 1.67 | 0.05 | Example |
| 26 | | 89 | 10 | P, B | 579 | 4 | 31.1 | 0.4 | 1.72 | 0.03 | Example |
| 27 | G | 87 | 12 | P, B | 607 | 8 | 29.7 | 0.8 | 1.48 | 0.08 | Example |
| 28 | | 88 | 11 | P, B | 601 | 15 | 30.0 | 1.5 | 1.49 | 0.15 | Example |
| 29 | | 87 | 11 | P, B | 601 | 8 | 28.3 | 0.8 | 1.23 | 0.08 | Example |
| 30 | | 89 | 9 | P, B | 571 | 4 | 31.5 | 0.4 | 1.60 | 0.04 | Example |
| 31 | | 90 | 9 | P, B | 562 | 19 | 32.0 | 1.9 | 1.21 | 0.19 | Example |
| 32 | | 88 | 8 | P, B | 559 | 15 | 32.2 | 1.4 | 1.28 | 0.14 | Example |
| 33 | | 88 | 8 | P, B | 553 | 8 | 32.5 | 0.6 | 1.29 | 0.07 | Example |
| 34 | | 99 | 1 | — | 421 | 22 | 39.8 | 2.8 | 1.14 | 0.21 | Comparative Example |
| 35 | | 0 | 21 | P, B | 749 | 14 | 24.0 | 1.4 | 0.92 | 0.16 | Comparative Example |
| 36 | | 88 | 7 | P, B | 542 | 13 | 33.2 | 1.2 | 1.42 | 0.11 | Example |
| 37 | | 88 | 8 | P, B | 556 | 13 | 32.3 | 1.1 | 1.39 | 0.12 | Example |
| 38 | | 86 | 2 | P, B | 436 | 8 | 41.3 | 0.6 | 1.71 | 0.06 | Comparative Example |
| 39 | L | 86 | 9 | P, B | 594 | 6 | 30.3 | 0.6 | 1.59 | 0.07 | Example |
| 40 | | 85 | 12 | P, B | 616 | 12 | 29.2 | 1.2 | 1.40 | 0.14 | Example |
| 41 | | 83 | 15 | P, B | 660 | 24 | 27.3 | 2.5 | 1.12 | 0.22 | Comparative Example |

*P; pearlite, B; bainite

Table 5 indicates our steel sheets as Nos. 23 through 33, 36, 37, 39, and 40, and satisfied our manufacturing conditions. These steel sheets had a TS of 440 MPa or more, an average r value of 1.20 or more, a ΔTS of less than 20 MPa, a ΔEL of less than 2.0%, and a Δaverage r value less than 0.20, which means these steel sheets are the cold rolled steel sheets which are excellent in terms of strength, deep drawability, and uniformity of mechanical property in a coil.

In particular, in the case of Nos. 25, 26 and 30 where the average cooling rate after finish rolling had been performed was 40° C./sec. or more to increase the r value by decreasing the grain size of the hot rolled steel sheet, an average r value, which was higher than that in the case where the average cooling rate after finish rolling has been performed was less than 40° C./sec., was achieved, and there was a significant decrease in ΔTS, ΔEL and Δaverage r value, which are the indicators of variation in mechanical properties in a coil. In the case of the steel sheets No. 23 through 30, 32, 33, 36, 37, 39, and 40 where the rolling reduction ratios of the last and second passes of finish rolling were respectively 10% or more and 15% or more to increase uniformity of mechanical property in a coil by promoting the precipitation of NbC and TiC at the stage of hot rolled steel sheet, ΔTS, ΔEL, and Δaverage r value were less than those in the case of No. 31 where the rolling reduction ratios of the last and second last passes were respectively less than 10% and less than 15%, which means that the former steel sheets are excellent in terms of uniformity of mechanical property in a coil. Moreover, in the case of No. 23, 25 through 27, 29, 30, and 39 where the rolling reduction ratios of the last and second last passes were respectively 13% or more and 18% or more, ΔTS, ΔEL, and Δaverage r value were further smaller, which means that these steel sheets are further excellent in terms of uniformity of mechanical property in a coil.

On the other hand, in the case of the steel sheet of comparative example No. 34, since the annealing temperature was lower than our range, the desired amount of martensite was not achieved, which resulted in a TS of less than 440 MPa and, since recrystallization was not completed, there was insufficient growth of a {111} recrystallization texture, which is effective in increasing the r value, which resulted in an average r value of less than 1.20, and since a uniform recrystallized microstructure was not achieved, ΔTS, ΔEL, and Δaverage r value, which are the indicators of variation in mechanical properties in a coil, were larger than our range.

In addition, in the case of the steel sheet of comparative example No. 35, since annealing was performed at a temperature higher than our range, that is, under the conditions for an austenite single phase, a ferrite phase, which is effective in increasing the r value, was not formed in the cooling process afterwards, which resulted in an average r value of less than 1.20.

In addition, in the case of the steel sheet of comparative example No. 38, since cooling was performed at an average cooling rate which was less than our range from the annealing temperature to the cooling stop temperature, the desired amount of martensite was not achieved, which resulted in a TS of less than 440 MPa. Moreover, in the case of the steel sheet of comparative example No. 41, since heating for annealing was performed at an average heating rate which was more than the range according to the present invention in a temperature range from 700° C. to 800° C., there was insufficient growth of an {111} recrystallization texture of a ferrite phase, which resulted in an average r value of less than 1.20, and since a uniform recrystallized microstructure was not achieved, ΔTS, ΔEL, and Δaverage r value, which are the indicators of variation in mechanical properties in a coil, were larger than our range.

INDUSTRIAL APPLICABILITY

The use application of the high strength cold rolled steel sheet is not limited to the material for automobile parts, and the steel sheet can also be suitably used for the other applications in which high strength and good deep drawability are required. Therefore, the steel sheet can be suitably used for the material for, for example, the parts of home electrical appliances and steel pipes.

The invention claimed is:

1. A high strength cold rolled steel sheet with excellent deep drawability and uniformity of mechanical property in a coil, the steel sheet having a chemical composition containing, by mass %, C: 0.010% or more and 0.060% or less, Si: more than 0.5% and 1.5% or less, Mn: 1.0% or more and 3.0% or less, P: 0.005% or more and 0.100% or less, S: 0.010% or less, sol.Al: 0.005% or more and 0.500% or less, N: 0.0100% or less, Nb: 0.010% or more and 0.100% or less, Ti: 0.015% or more and 0.150% or less, and the balance comprising Fe and inevitable impurities, wherein expressions (1), (2), and (3) below are satisfied, a microstructure includes, in area fraction, 70% or more of a ferrite phase and 3% or more of a martensite phase, and a tensile strength is 440 MPa or more and an average r value is 1.20 or more:

$$(Nb/93)/(C/12)<0.20 \quad (1),$$

$$0.005 \leq C^* \leq 0.025 \quad (2),$$

$$(Nb/93+Ti^*/48)/(C/12) \geq 0.150 \quad (3),$$

where, atomic symbol M represents the content (mass %) of the chemical element represented by the symbol M in relational expressions (1), (2), and (3), where $C^*=C-(12/93)Nb-(12/48)Ti^*$ and where $Ti^*=Ti-(48/14)N-(48/32)S$, in which $Ti-(48/14)N-(48/32)S=0$ in the case where $Ti-(48/14)N-(48/32)S \leq 0$.

2. The high strength cold rolled steel sheet according to claim 1, wherein the chemical composition further contains, by mass %, at least one chemical element selected from among Mo, Cr, and V in a total amount of 0.50% or less.

3. The high strength cold rolled steel sheet according to claim 1, wherein the chemical composition further contains, by mass %, one or two selected from Cu: 0.30% or less and Ni: 0.30% or less.

4. A method of manufacturing a high strength cold rolled steel sheet with excellent deep drawability and uniformity of mechanical property in a coil, comprising:

hot rolling a steel material having a chemical composition according to claim 1;

cold rolling; and annealing, wherein a rolling reduction ratio of a last pass of finish rolling in the hot rolling is 10% or more and a rolling reduction ratio of a second to last pass is 15% or more, and the cold rolled steel sheet is heated up to a temperature of 800° C. to 900° C. at an average heating rate of less than 3° C./sec. in a temperature range from 700° C. to 800° C. and then cooled down to a cooling stop temperature of 500° C. or lower at an average cooling rate of 5° C./sec. or more in the annealing.

5. The method according to claim 4, further comprising cooling that starts within three seconds after the finish rolling has been finished in the hot rolling, cooling the hot rolled steel sheet down to a temperature of 720° C. or lower at an average cooling rate of 40° C./sec. or more, coiling the cooled steel sheet at a temperature of 500° C. to 700° C., and cold rolling the coiled steel sheet with the rolling reduction ratio of 50% or more.

6. The high strength cold rolled steel sheet according to claim 2, wherein the chemical composition further contains, by mass %, one or two selected from Cu: 0.30% or less and Ni: 0.30% or less.

7. A method of manufacturing a high strength cold rolled steel sheet with excellent deep drawability and uniformity of mechanical property in a coil, comprising:

hot rolling a steel material having a chemical composition according to claim 2;

cold rolling; and annealing, wherein a rolling reduction ratio of a last pass of finish rolling in the hot rolling is 10% or more and a rolling reduction ratio of a second to last pass is 15% or more, and the cold rolled steel sheet is heated up to a temperature of 800° C. to 900° C. at an average heating rate of less than 3° C./sec. in a temperature range from 700° C. to 800° C. and then cooled down to a cooling stop temperature of 500° C. or lower at an average cooling rate of 5° C./sec. or more in the annealing.

8. A method of manufacturing a high strength cold rolled steel sheet with excellent deep drawability and uniformity of mechanical property in a coil, comprising:

hot rolling a steel material having a chemical composition according to claim 3;

cold rolling; and annealing, wherein a rolling reduction ratio of a last pass of finish rolling in the hot rolling is 10% or more and a rolling reduction ratio of a second to last pass is 15% or more, and the cold rolled steel sheet is heated up to a temperature of 800° C. to 900° C. at an average heating rate of less than 3° C./sec. in a temperature range from 700° C. to 800° C. and then cooled down to a cooling stop temperature of 500° C. or lower at an average cooling rate of 5° C./sec. or more in the annealing.

9. A method of manufacturing a high strength cold rolled steel sheet with excellent deep drawability and uniformity of mechanical property in a coil, comprising:

hot rolling a steel material having a chemical composition according to claim 6;

cold rolling; and annealing, wherein a rolling reduction ratio of a last pass of finish rolling in the hot rolling is 10% or more and a rolling reduction ratio of a second to last pass is 15% or more, and the cold rolled steel sheet is heated up to a temperature of 800° C. to 900° C. at an average heating rate of less than 3° C./sec. in a temperature range from 700° C. to 800° C. and then cooled down to a cooling stop temperature of 500° C. or lower at an average cooling rate of 5° C./sec. or more in the annealing.

10. The method according to claim 7, further comprising cooling that starts within three seconds after the finish rolling has been finished in the hot rolling, cooling the hot rolled steel sheet down to a temperature of 720° C. or lower at an average cooling rate of 40° C./sec. or more, coiling the cooled steel sheet at a temperature of 500° C. to 700° C., and cold rolling the coiled steel sheet with the rolling reduction ratio of 50% or more.

11. The method according to claim 8, further comprising cooling that starts within three seconds after the finish rolling has been finished in the hot rolling, cooling the hot rolled steel sheet down to a temperature of 720° C. or lower at an average cooling rate of 40° C./sec. or more, coiling the cooled steel sheet at a temperature of 500° C. to 700° C., and cold rolling the coiled steel sheet with the rolling reduction ratio of 50% or more.

12. The method according to claim 9, further comprising cooling that starts within three seconds after the finish rolling has been finished in the hot rolling, cooling the hot rolled steel sheet down to a temperature of 720° C. or lower at an average cooling rate of 40° C./sec. or more, coiling the cooled steel sheet at a temperature of 500° C. to 700° C., and cold rolling the coiled steel sheet with the rolling reduction ratio of 50% or more.

* * * * *